US005509718A

United States Patent [19]

Neary

[11] Patent Number: 5,509,718

[45] Date of Patent: Apr. 23, 1996

[54] SELF-SEALING POLYVINYL CHLORIDE SEAT COVER FOR A DINING CHAIR

[76] Inventor: Lynn L. Neary, 8262 Honor Pl., Cotati, Calif. 94931

[21] Appl. No.: 298,602

[22] Filed: Mar. 31, 1994

[51] Int. Cl.[6] ..... A47C 31/00

[52] U.S. Cl. ..... 297/228.12; 297/218.1; 297/219.1; 5/496; 5/497

[58] Field of Search ..... 297/219.1, 228.12, 297/218.1, 219.12; 5/496, 497

[56] References Cited

U.S. PATENT DOCUMENTS

| | | | |
|---|---|---|---|
| 2,205,302 | 6/1940 | Morgenstern | 297/228.12 |
| 2,313,337 | 3/1943 | Gurke | 5/496 |
| 2,637,136 | 5/1953 | Mark | 5/496 |
| 3,243,827 | 4/1966 | Kintner | 5/496 |
| 3,413,665 | 12/1968 | Amet | 5/496 |
| 4,144,602 | 3/1979 | Fernandes | 5/496 |
| 4,651,371 | 3/1987 | Hahn | 5/496 |

*Primary Examiner*—Peter R. Brown
*Assistant Examiner*—Anthony D. Barfield
*Attorney, Agent, or Firm*—Harold D. Messner

[57] ABSTRACT

A one-piece plastic cover for a seat of a dining chair is described. The cover comprises a single layer of polyvinyl chloride polymer having broad double polished top and bottom surfaces of sufficient tackiness to adhere to each other but allow fabric associated with clothes of the user to slide without adherence thereover. The top and bottom broad surfaces of the cover are constructed of a generally rectangular shape wherein the broad surfaces terminate in a front edge, a pair of side edges, a rear edge. The cover also defines a longitudinal axis of symmetry bisecting the front and rear edges. A pair of front corners are formed at the intersection of the front and side edges of the cover. A pair of diagonal slots extending inwardly from the pair of front corners toward the axis of symmetry wherein each of the diagonal slots permit spaced-apart corner sectors formed integrally within the cover, say on opposite sides of said slot can be overlapped and create tension to associated front and side sections of the cover. Such tension causes the front and side sections of the cover to fold downward in conformance with the chair when fitted thereto wherein broad surfaces of the corner sectors are sufficient tacky to disconnectably adhere to each other when overlapped and broad pressure applied thereto but allow separation without lose of adhesion power when disconnectable pressure is applied.

12 Claims, 2 Drawing Sheets

SELF-SEALING POLYVINYL CHLORIDE SEAT COVER FOR A DINING CHAIR

SCOPE OF THE INVENTION

The present invention relates to seat cover to accommodate a variety of dining chairs in which the cover is formed a single layer of self-sealing polyvinyl chloride polymer. One advantage of the present invention is self-adherence allows attachment to a variety of shaped dining chairs.

BACKGROUND OF THE INVENTION

U.S. Pat. No. 4,840,841 shows a disposable seat liner made of cellulosic fibers bonded to a backing sheet and having a construction to permit seat belts to penetrate thereover to strap in the user.

However, experience has shown that there is a need for a cover for a dining chair that is translucent to permit viewing of the fabric below yet be protective thereof especially if such chair is to be used by children. In addition, the cover should be wipable with sponge, be not easily displaced when used yet be easily removable, if desired.

SUMMARY OF THE INVENTION

A one-piece plastic cover for a seat of a dining chair is described. The cover comprises a single layer of polyvinyl chloride polymer having broad double polished top and bottom surfaces of sufficient tackiness to adhere to each other but allow fabric associated with clothes of the user to slide without adherence thereover. The top and bottom broad surfaces of the cover are constructed of a generally rectangular shape wherein the broad surfaces terminate in a front edge, a pair of side edges, a rear edge. The cover also defines a longitudinal axis of symmetry bisecting the front and rear edges. A pair of front corners are formed at the intersection of the front and side edges of the cover. A pair of diagonal slots extending inwardly from the pair of front corners toward the axis of symmetry wherein each of the diagonal slots permit spaced-apart corner sectors formed integrally within the cover, say on opposite sides of sad slot can be overlapped and create tension to associated front and side sections of the cover. Such tension causes the front and side sections of the cover to fold downward in conformance with the chair when fitted thereto wherein broad surfaces of the corner sectors are sufficient tacky to disconnectably adhere to each other when overlapped and broad pressure applied thereto but allow separation without lose of adhesion power when disconnectable pressure is applied.

DETAILED DESCRIPTION OF THE INVENTION

Figure 1:
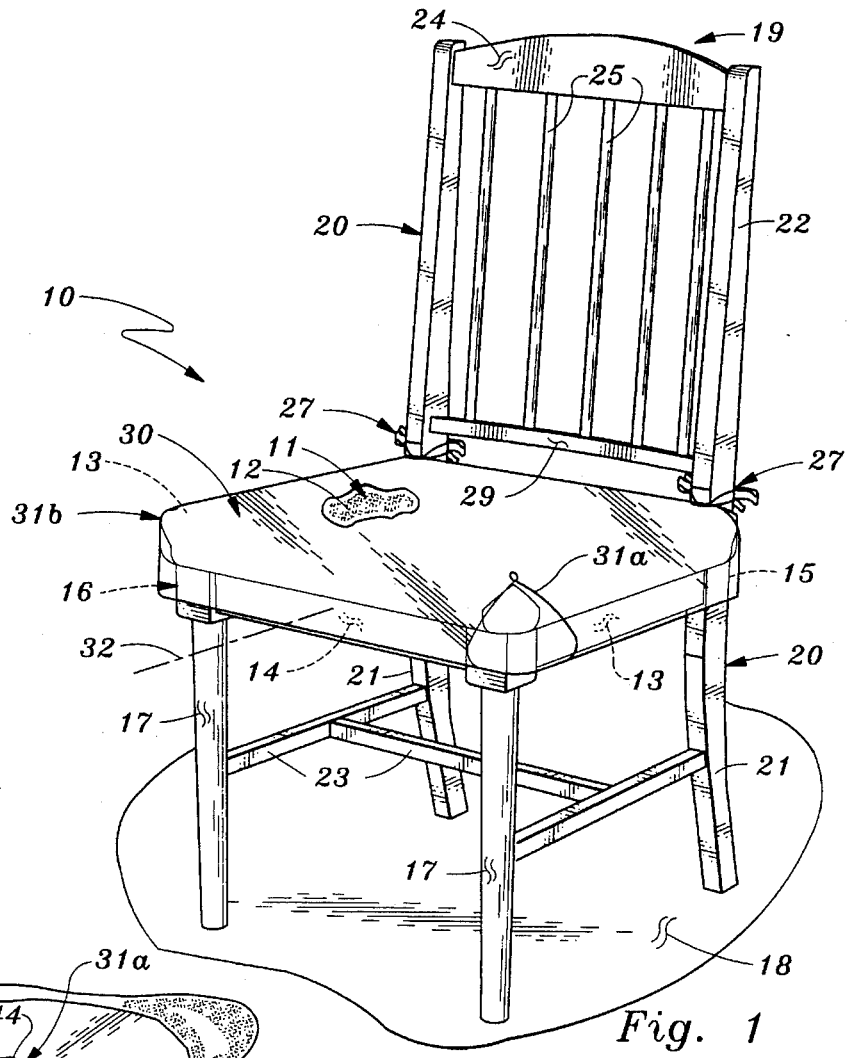
FIG. 1 is a perspective view of a dining chair having a seat fitted with one-piece seat cover of the invention wherein a front left corner of the cover is slotted and prominently shown in adherence to the associated left edge of the seat.

As shown in FIG. 1, a typical dining chair 10 is depicted. The chair 10 includes a seat 11. Broad top surface 12 of the seat 11 terminates in first and second side rails 13, front rail 14 and rear rail 15 forming a frame generally indicated at 16 for support of the seat 11. A pair of front legs 17 attached to broad bottom surface of the seat 11 and extend into contact with floor 18. A rear leg assembly 19 includes a pair of upright support members 20 intersecting the rear rail 15 of the frame 16. Each upright support member 20 is divided into a leg section 21 and a back section 22. Below the seat 11, a series of supports 23 attach between the legs sections 21 and the pair of front legs 17 for stability purposes. Above the seat 11, the back sections 22 of the upright support members 20, are provided with upright and lateral rails 24, 25, respectively. The lower of the lateral rail 24 is seen to be positioned above the rear rail 15 so that seat cover 30 of the invention can be attached to back section 22 of the upright members 20, viz., via a pair of strap assemblies 27 in the manner explained below. Note that the seat cover 30 is also provided with a pair of diagonals slots 31*a*, 31*b*, both of which extend toward longitudinal axis of symmetry 32 of the cover 30 above the pair of front legs 17, such slots 31*a*, 31*b* being individually capable of being manipulated as explained below to permit the cover 30 to fold downward in conformance with the side and front trails 13, 14 of the frame 16 and to be attached thereto.

Figure 2:
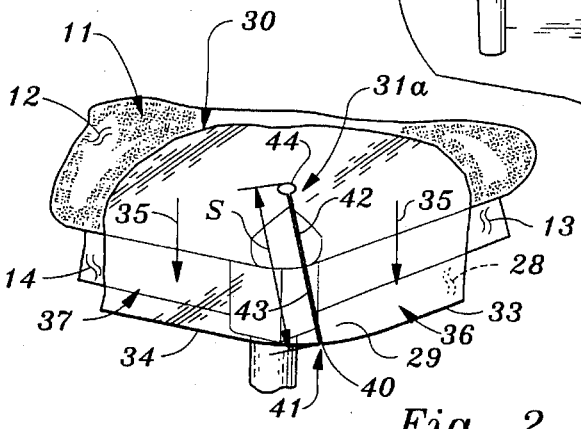
FIGS. 2–4 are detailed perspective views of the front left cover illustrating the steps used by the user to secure the cover relative to the seat wherein a diagonal slot extending inwardly toward a longitudinal axis of symmetry a distance D wherein the slot is seen to define side walls terminating in enlarged arcuate end wall (FIG. 2), wherein the diagonal slot permits reorientation of one side wall relative to the other (FIG. 3) in the vicinity of the associated front leg of the chair followed by orientation of the side wall relative to the first side all (FIG. 4) whereby associated broad surfaces of the side walls after overlapping has occurred, adhere each to the other thereby permitting the front and side edges of the broad surfaces to fold downward in conformance with the side and front edges of the seat.
Figure 3:
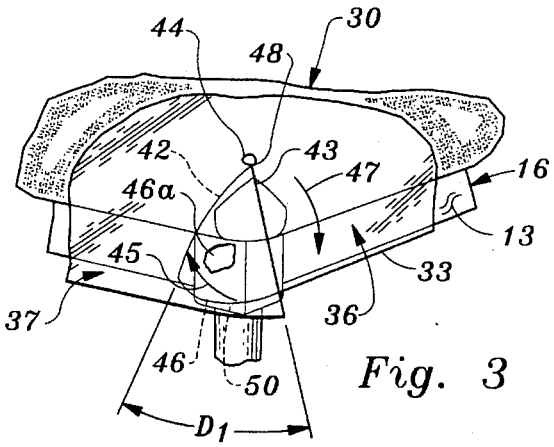
Figure 4:
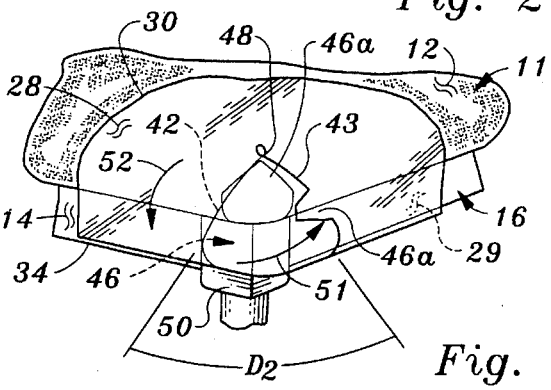

FIGS. 2–4 shows manipulation and attachment of the diagonal slots 31*a* in more detail. Since the slot 31*a* is identical to slot 31*b*, the description that follows is equally applicable.

FIG. 2 shows the diagonal slot 31*a* of the cover 30 after the latter has to laid atop the fabric-covered top surface 12 of the seat 11 but before the user starts manipulation operations. Note that side and front edges 33, 34, respectively, of the cover 30 have a slight downward cast as indicated by arrows 35 so that side section 36 and front section 37 of the cover 30 are slightly offset from side and front rails 13, 14, respectively, of the frame 16. That is, bottom broad surface 28 of the cover 30 parallel to top surface 29, does not contact the rails 13, 14. But the configuration of the slot 31*a* is clearly shown, viz., such slot 31*a* has an opening 40 at junction 41 of the side and front edges 33, 34 of the cover 30 and is defined by a pair of side walls 42, 43 that extend a distance S from forward opening 40, terminating in enlarged end wall 44 of a circular cross section. Distance S is about 3–5 inches, while the diameter of the end wall 44 is about ¼ inch.

FIG. 3 shows the position of side wall 42 of the cover 30 after the latter has been slid under the side wall 43 in the direction of arrow 45 to permit side edge 33 to be downwardly folded adjacent to side rail 13 of frame 16. In such position, there is an overlapping corner sector 46 of the side section 36 having a top surface 46*a* that overlaps the front section 37 and permits the side section 36 to be located in contact with side rail 13 of the frame 16 via relocation of the side section 36 in the direction of arrow 47. Such sector 46 has an origin point 48 at the intersection of the start of enlarged end wall 44 and side wall 43, and defines a maximum lateral distance D1 at sector end edge 50 of the sector 46. Such sector end edge 50 extends between the terminus of the side wall 42 and a vertical plane through the side wall 43.

FIG. 4 shows the position of the side wall 43 after the latter has been slide away from its position depicted in FIG. 3 in the direction of arrow 51 so that maximum distance D2 at sector end edge 50 of the sector 46 is approximately doubled, as shown in FIG. 4. Such manipulation permits front edge 34 to be downwardly folded adjacent to front rail 14 of the frame 16 in the direction of arrow 52. Thus in such position, the area of the sector 46 is approximately double over that depicted in FIG. 3. That is, even though the origin point 48 remains at a like position, the maximum distance D2 is now twice D1 of FIG. 3 at end edge 50. Moreover, there is exact duplicate of the sector 46 outlined on top surface 28 of the cover 30 whereby their adjacent broad surfaces 46*a* and 46*a'*, respectively, can be brought into attaching contact.

The reason for such attaching contact occurs, results from the nature of the material used in constructing the seat cover 30 of the invention. Such cover 30 as depicted in FIG. 4 is preferably formed as a single layer (0.011 inch thick) of polyvinyl chloride polymer in which top and bottom surfaces 28, 29 have been double polished to provide sufficient tackiness relative to each other thereby allowing adjacent broad surfaces 46*a* and 46*a'* associated with such surfaces 28, 29 in the vicinity of sector 46 to disconnectably attach when brought into contact, see FIGS. 1–4. In addition, due to the translucence of the cover 30, the fabric-covered top surface 12 of the seat 11 is still visible, However, when brought into contact with conventional clothing fabric such as cotton, polyesters and the like worn by a user, the top surface 28 of the cover 30 does not adhere thereto but allows relative movement thereover.

Figure 5:
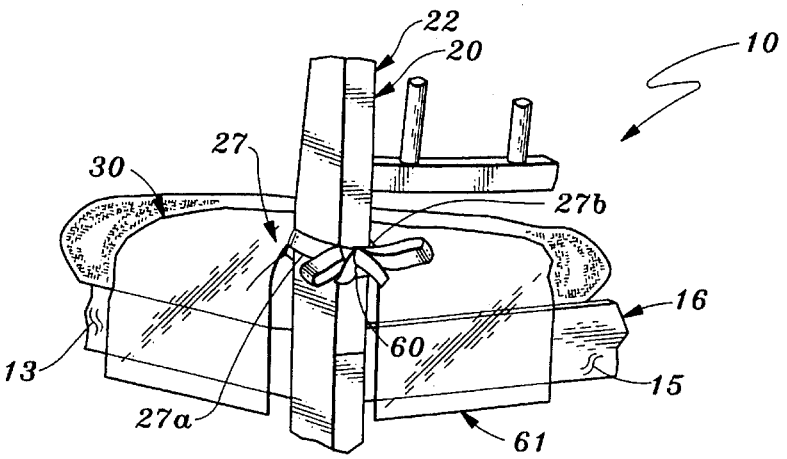
FIG. 5 is reverse detail perspective view of the left back corner of the chair of FIG. 1 in which a pair of polyvinyl chloride straps at the rear of the cover of the invention are tied to a portion of the back of the chair in which a crown subedge of the rear edge of the cover is seen to fold downward over the rear edge of the seat.

FIG. 5 shows how each strap assembly 27 is used to secure the seat cover 30 of the invention relative to back section 22 of the upright members 20 of the chair 10.

Figure 6:
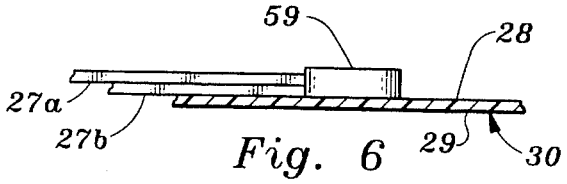
FIG. 6 is a section taken along line 6—6 of FIG. 7 wherein the top broad surface of the cover of the invention is seen to fitted with an integral-formed grommet fastener in attachment with ends of a pair of polyvinyl chloride straps depending from each fasteners whereby opposite free ends of the straps can be used to tie about the back of the chair as shown in FIG. 5.

As shown, each strap assembly 27 is divided into two straps 27*a*, 27*b* which wrap around the back section 22 above side and rear rails 13, 15 of the frame 16 in opposite directions and tied together in a bow 60 adjacent to rear edge 61 of the cover 30. Each strap 27*a*, 27*b* is formed of a single layer of polyvinyl chloride polymer and is attached to the top surface 27 of the cover 30 via integral formed button weld 59 as depicted in FIG. 6. Such weld 59 results from a conventional RF welding apparatus incorporating a female and male fixture that is brought into contact with straps 27*a*, 27*b* and cover 30 in the vicinity thereof which causes melting of the top and bottom surfaces 28, 29 and straps 27*a*, 27*b* into the cylindrical form, as shown.

Figure 7:
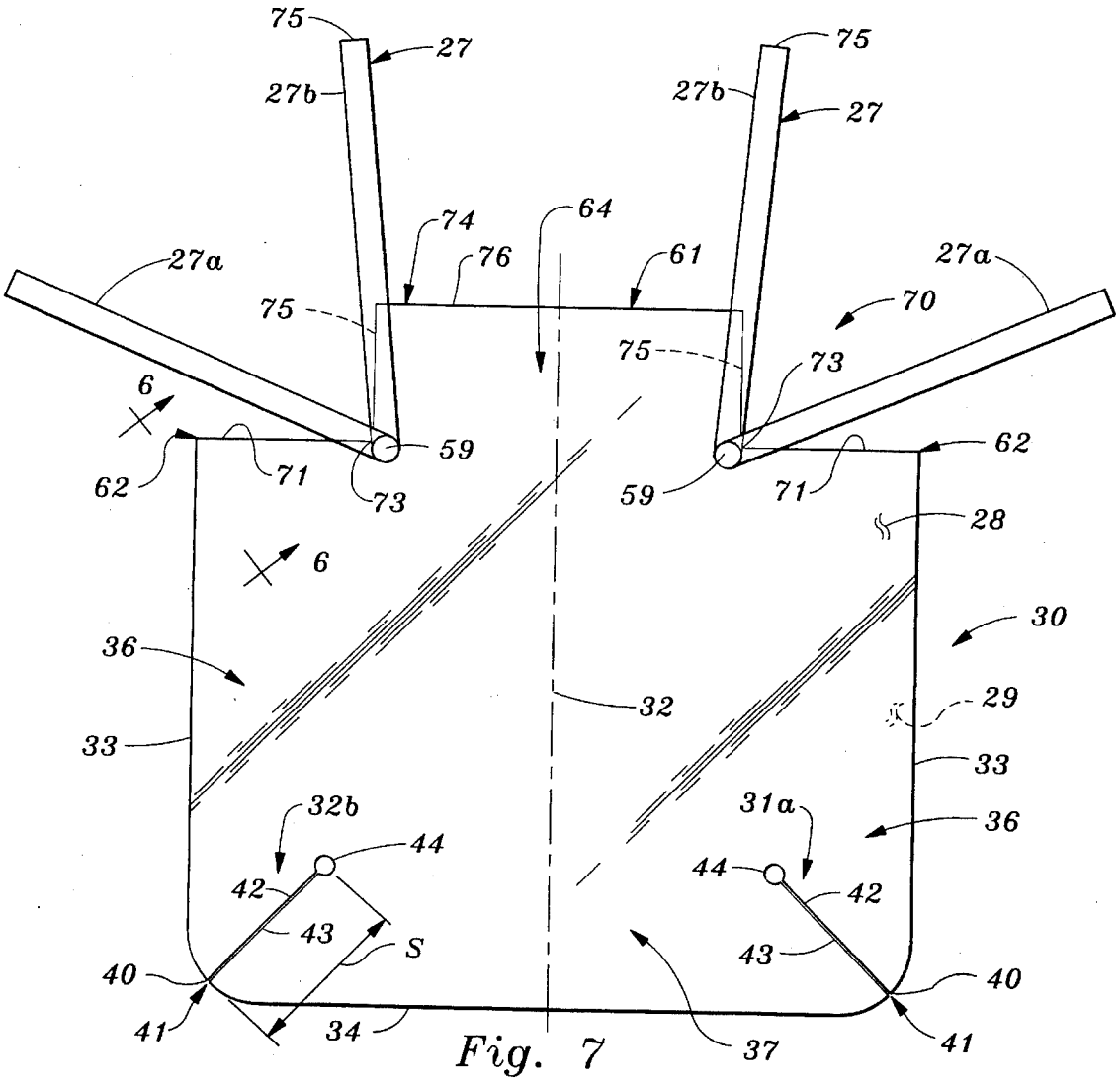
FIG. 7 is a plan view of the cover of FIG. 1 before attachment relative to the chair.

FIG. 7 shows cover 30 in plan view before attachment. As shown, such cover 30 is a general rectangular shape and includes top and bottom double polished surfaces 28, 29. These surfaces 28, 29 terminate in side edges 33 associated with a pair of side sections 36, front edge 34 associated with front section 37 and rear edge 61 of rear section 64 as previously mentioned. Axis of symmetry 32 bisects the front edge 34 and the rear edge 61 and is parallel to the side edges 33. The front edge 34 intersects the side edges 33 at forward junctions 41, while the rear edge 61 intersects the same side edges 33 at rear junctions 62. As previously described, each of the forward junctions 41 is coincident with either diagonal slots 31*a* or 31*b* as previously mentioned. That is, each diagonal slot 31*a* or 31*b* includes side walls 42, 43 that extends a distance S from forward opening 40 terminating in enlarged end wall 44 of circular cross section.

Rear edge 61 of the rear section 64 includes a series of bifurcated subedges generally indicated at 70. Such series of subedges 70 includes a first pair of stub subedges 71 that start from the rear junctions 62 and proceed inwardly toward the axis of symmetry 32. Such stub subedges 71 terminate at subcorners 73 at positions equally offset from the axis of symmetry 32. Also attached to subcorners 73 is a crown subedge 74. The crown subedge 74 includes a pair of side subedges 75 parallel to the side edges 33 of the cover 30 and a top subedge 76 parallel to the front edge 34. At the subcorners 73 is a pair of strap assemblies 27 comprising a pair of integral-formed button welds 59 each of which attach to straps 27*a*, 27*b* of rectangular cross section. Free ends 75 of the straps 27*a*, 27*ba* can be used to attach the cover 30 relative to the chair 10 of FIG. 1 and prevent relative displacement. The straps 27*a*, 27*b* are formed of double polished polyvinyl chloride polymer in the same manner as the cover 30.

While the present invention has been described in the form of a preferred embodiment it is understood that various modifications thereto are apparent to those skilled in the art within the scope of the invention as defined within the appended claims.

I claim:

1. A one-piece cover for a seat of a chair, comprising a single layer of transparent polyvinyl chloride polymer having broad double polished top and bottom surfaces of sufficient tackiness to adhere to each other without need for a separate adhesive therebetween but allow fabric associated with clothes of the user to slide without adherence thereover, said top and bottom broad surfaces being of generally rectangular shape terminating in a front edge, a pair of side edges, a rear edge and defining a longitudinal axis of symmetry bisecting said front and rear edges parallel to said side edges, said front edges intersecting said side edges at a pair of front junctions each of which defining a diagonal slot extending inwardly therefrom toward said axis of symmetry a predetermined distance wherein each of said diagonal slots permits spaced-apart corner sectors on opposite sides thereof to be overlapped and create tension to associated front and side sections to cause them to fold downward relative to said axis of symmetry, said broad surfaces of said corner sectors being sufficiently tacky to disconnectably adhere to each other when overlapped without need for a separate adhesive therebetween but allow separation without lose of adhesion power when disconnectable pressure is applied.

2. The one-piece cover of claim 1 in which said rear edge of said cover includes an associated rear section depending from said rear edge, as well as defines a series of bifurcated subedges, said bifurcated subedges comprising a first pair of stub subedges starting from a pair of rear junctions of said rear and side edges and extending toward said axis of symmetry, and a crown subedge that joins said stub subedges at a pair of subcorners positioned equal lateral distances from said axis of symmetry.

3. The one-piece cover of claim 2 with the addition of a pair of strap assemblies each of which being attached to said top surface of said cover at said rear section adjacent to one of said subcorners of said rear edge, each of said pair of strap assemblies including first and second straps of rectangular cross section formed of double polished polyvinyl chloride polymer and including free ends that can be tied relative to said chair when attached thereto to prevent displaced thereof during use.

4. The one-piece cover of claim 3 in which each of said first and second straps of each of said pair of strap assemblies includes an opposite end to said free end that is heat welded to said top surface of said cover wherein a cylindrical shaped weld is formed thereat.

5. The one-piece cover of claim 1 in which each of said pair of diagonal slots include parallel side walls defining adjacent edges of said corner sectors, said side walls terminating in an enlarged arcuate end wall wherein said side walls can be tensioned to cause reorientation relative to said axis of symmetry, whereby said side walls can overlap and permit said corner sectors to disconnectably adhere.

6. For preventing soilage, the combination comprising a chair having a seat and front and rear edge depending downward relative to said seat, said seat being supported by a frame in a common horizontal plane and defining a top broad surface, a one-piece cover attached across said top broad surface of said seat and comprising a single layer of transparent polyvinyl chloride polymer having broad double polished top and bottom surfaces of sufficient tackiness to adhere to each other without need for a separate adhesive therebetween but allow fabric associated with clothes of the user to slide without adherence thereover, said top and bottom broad surfaces of said cover being of generally rectangular shape terminating in a front edge, a pair of side edges, a rear edge and defining a longitudinal axis of symmetry bisecting said front and rear edges parallel to said side edges, said front edges intersecting said side edges at a pair of front junctions each of which defining a diagonal slot extending inwardly therefrom toward said axis of symmetry a predetermined distance wherein each of said diagonal slots permit spaced-apart corner sectors on opposite sides of said slot to be overlapped and create tension to associated front and side sections to cause them to fold downward relative to said axis of symmetry in conformance with said frame of said chair when fitted thereof, said broad surfaces of said corner sectors being sufficiently tacky to disconnectably adhere to each other when overlapped and broad pressure applied thereto without need for a separate adhesive therebetween but allow separation without lose of adhesion power when disconnectable pressure is applied.

7. The combination of claim 6 in which said rear edge of said cover includes an associated rear section depending from said rear edge toward said front edge, as well as defines a series of bifurcated subedges, said bifurcated subedges comprising a first pair of stub subedges starting from a pair of rear junctions of said rear and side edges and extending toward said axis of symmetry, and a crown subedge that joins said stub subedges at a pair of subcorners positioned equal lateral distances from said axis of symmetry.

8. The combination one-piece cover of claim 7 with the addition of a pair of strap assemblies each of which being attached to said top surface of said cover at said rear section adjacent to one of said subcorners of said rear edge, each of said pair of strap assemblies including first and second straps of rectangular cross section formed of double polished polyvinyl chloride polymer and including free ends that can be tied relative to said chair to prevent displaced thereof.

9. The combination of claim 8 in which each of said first and second straps of each of said pair of strap assemblies includes an opposite end to said free end that is heat welded to said top surface of said cover wherein a cylindrical shaped weld is formed thereat.

10. The combination of claim 8 in which said chair is a dining chair subject to soilage by children wherein said frame of said dining chair includes a front rail, a pair of side rails and a rear rail connected in a common plane to form a horizontal support for said seat, and wherein said rear legs of said dining chair are components of a rear leg assembly that includes a back frame integrally attached to said rear legs that extend in upward direction relative to said seat to provide a vertical support for a user's back, said first and second straps of each of said pair of strap assemblies being tied relative to said rear leg assembly to releasably attach said cover relative to said chair.

11. The combination of claim 6 in which each of said pair of diagonal slots include parallel side walls defining adjacent edges of said corner sectors, said side walls terminating in an enlarged arcuate end wall wherein said side walls can tensioned to cause reorientation in the vicinity of said front legs of said chair whereby said side walls can overlap and permit said corner sectors to disconnectably adhere.

12. The combination of claim 6 in which said top surface of said seat of said chair is covered with a decorative fabric and wherein said single layer of transparent polyvinyl chloride polymer comprising said cover permits said decorative fabric covering said seat of said chair to be readily observed.

* * * * *